US007610908B2

(12) United States Patent
Gardner, Jr. et al.

(10) Patent No.: US 7,610,908 B2
(45) Date of Patent: Nov. 3, 2009

(54) PNEUMATICALLY OPERATED PROJECTILE LAUNCHING DEVICE

(75) Inventors: William Gardner, Jr., Latrobe, PA (US); Adam Gardner, Latrobe, PA (US)

(73) Assignee: Smart Parts, Inc., Loyalhanna, PA (US)

( * ) Notice: Subject to any disclaimer, the term of this patent is extended or adjusted under 35 U.S.C. 154(b) by 18 days.

(21) Appl. No.: 11/480,093

(22) Filed: Jun. 29, 2006

(65) Prior Publication Data

US 2006/0243264 A1 Nov. 2, 2006

Related U.S. Application Data

(63) Continuation of application No. 10/642,044, filed on Aug. 15, 2003, now Pat. No. 7,100,593, which is a continuation of application No. 10/254,891, filed on Sep. 24, 2002, now Pat. No. 6,637,421, which is a continuation of application No. 09/490,735, filed on Jan. 25, 2000, now Pat. No. 6,474,326, which is a continuation of application No. 08/586,960, filed on Jan. 16, 1996, now Pat. No. 6,035,843.

(51) Int. Cl.
*F41B 11/00* (2006.01)

(52) U.S. Cl. ..... 124/77

(58) Field of Classification Search ..... 124/71–77; 89/7

See application file for complete search history.

(56) References Cited

U.S. PATENT DOCUMENTS

| | | | | | |
|---|---|---|---|---|---|
| 645,932 | A * | 3/1900 | Beck et al. | 89/125 |
| 2,116,860 | A * | 5/1938 | Blaylock et al. | 89/1.4 |
| 2,568,432 | A * | 9/1951 | Cook | 124/65 |
| 2,994,313 | A * | 8/1961 | Grahn | 124/6 |
| 3,653,538 | A * | 4/1972 | Lamar | 701/217 |
| 3,800,657 | A * | 4/1974 | Broxholm et al. | 89/7 |
| 3,802,407 | A * | 4/1974 | Imazu | 124/59 |
| 3,915,143 | A * | 10/1975 | Waller | 124/77 |
| 4,148,245 | A * | 4/1979 | Steffanus et al. | 89/7 |
| 4,362,145 | A * | 12/1982 | Stelcher | 124/32 |
| 4,654,008 | A * | 3/1987 | Elmore | 434/16 |
| 4,664,631 | A * | 5/1987 | Pederson et al. | 434/16 |
| 4,770,153 | A * | 9/1988 | Edelman | 124/72 |
| 5,267,501 | A * | 12/1993 | Shillig | 89/1.51 |
| 5,361,700 | A * | 11/1994 | Carbone | 102/439 |
| 5,515,838 | A * | 5/1996 | Anderson | 124/76 |
| 5,613,483 | A * | 3/1997 | Lukas et al. | 124/73 |
| 5,727,538 | A * | 3/1998 | Ellis | 124/77 |

FOREIGN PATENT DOCUMENTS

| | | |
|---|---|---|
| JP | 60-189793 | 12/1985 |
| JP | 3186198 | 8/1991 |
| JP | 6137789 | 5/1994 |

* cited by examiner

*Primary Examiner*—Troy Chambers
(74) *Attorney, Agent, or Firm*—SIMPLE IP Law, P.C.; Craig R. Rogers

(57) ABSTRACT

A paintball gun preferably includes an electro-pneumatic flow distribution mechanism such as a solenoid valve having a port connected to a pneumatic mechanism. For instance, the solenoid valve may include an input port receiving compressed gas from a compressed gas supply and an output port connected to the pneumatic mechanism. The solenoid valve can be enabled to direct compressed gas to and/or from the pneumatic mechanism to operate a bolt. The bolt may be coupled to the pneumatic mechanism.

18 Claims, 4 Drawing Sheets

PNEUMATICALLY OPERATED PROJECTILE LAUNCHING DEVICE

This application is a continuation of, and claims priority from, U.S. patent application Ser. No. 10/642,044, filed Aug. 15, 2003 now U.S. Pat. No. 7,100,593; which is a continuation of U.S. patent application Ser. No. 10/254,891 (now U.S. Pat. No. 6,637,421), filed on Sep. 24, 2002; which is a continuation of, and claims priority from, U.S. patent application Ser. No. 09/490,735 (now U.S. Pat. No. 6,474,326 B1), filed Jan. 25, 2000; which is a continuation of, and claims priority from, U.S. patent application Ser. No. 08/586,960 (now U.S. Pat. No. 6,035,843), filed Jan. 16, 1996, the contents of which are herein incorporated by reference in their entirety.

FIELD OF THE INVENTION

The present invention relates to a pneumatically operated projectile launching device. A preferred embodiment of the invention is designed for use in the recreational sport of "Paintball" (also known as "Survival" or "Capture the Flag").

BACKGROUND OF THE INVENTION

The current invention consists of a device for launching a projectile using pneumatic force. Guns using pneumatic force to propel a projectile are well known. In particular, it is well known to use pneumatic force to fire a fragile spherical projectile containing a colored, viscous substance (known as a "paintball") which bursts upon impact with a target. However pneumatically operated guns used in paintball applications (as well as existing pneumatically operated guns in general) suffer from several deficiencies affecting the accuracy of the shot which are eliminated by the present invention.

It is an object of the present invention to provide a projectile launching device that uses electro-pneumatic control to release the pneumatic force that propels the projectile.

It is also an object of the present invention to provide a projectile launching device for use in the recreational and professional sport of paintball that uses electro-pneumatic control to release the pneumatic force that propels the projectile.

SUMMARY OF THE INVENTION

The pneumatically operated projectile launching device is preferably comprised of three principal elements: a body which houses and interconnects all of the pneumatic components and also houses the electrical power source, a grip mounted to the body which includes an electrical switch that activates a launching sequence, and an electrical control unit housed within both the body and the grip which directs flow between the pneumatic components to load, cock and fire the gun.

BRIEF DESCRIPTION OF DRAWINGS

FIG. (1) is a side view of the pneumatically operated projectile launching device.

FIG. (2) is a rear view of the pneumatically operated projectile launching device.

Figure 1:
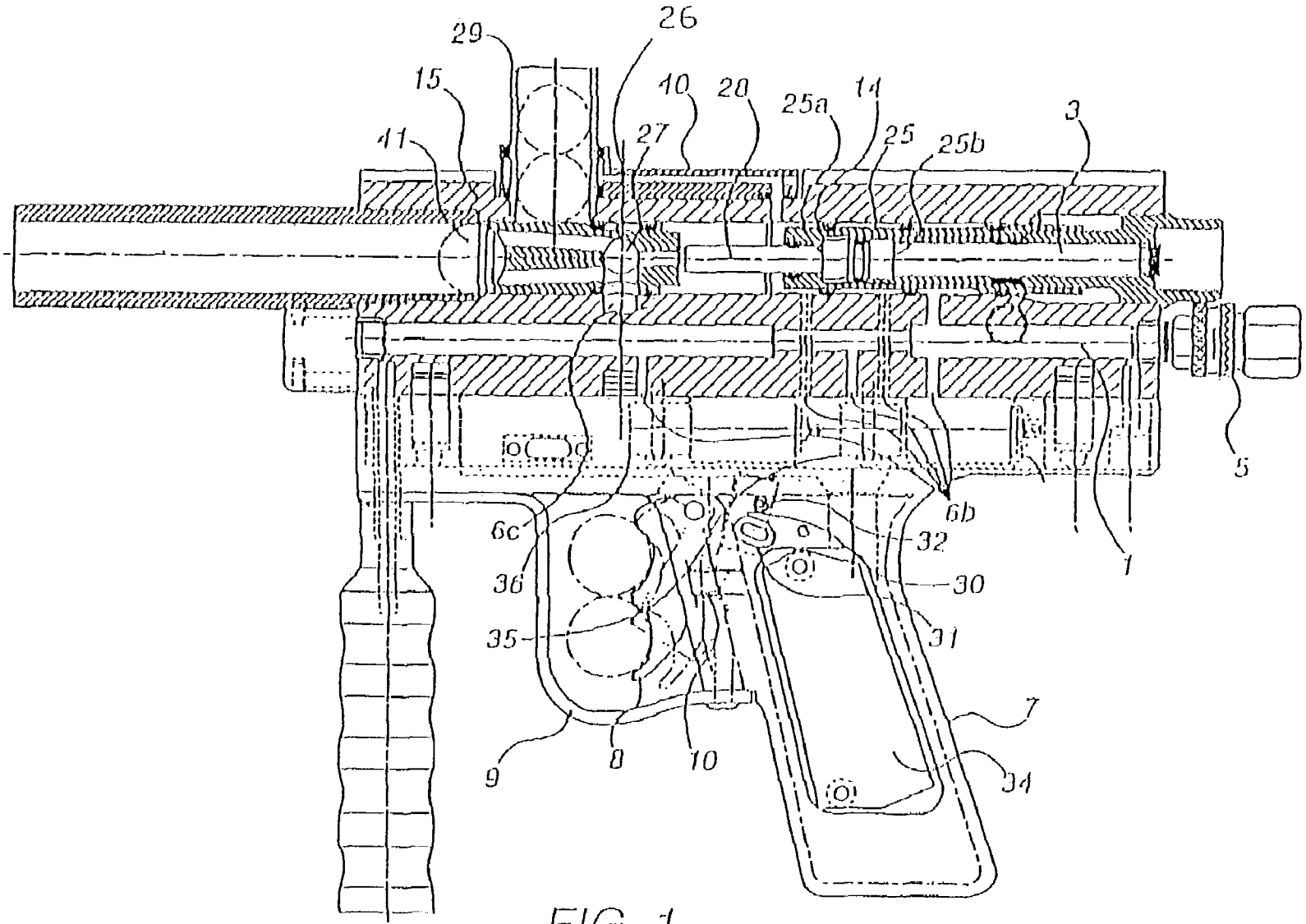
Figure 1A:
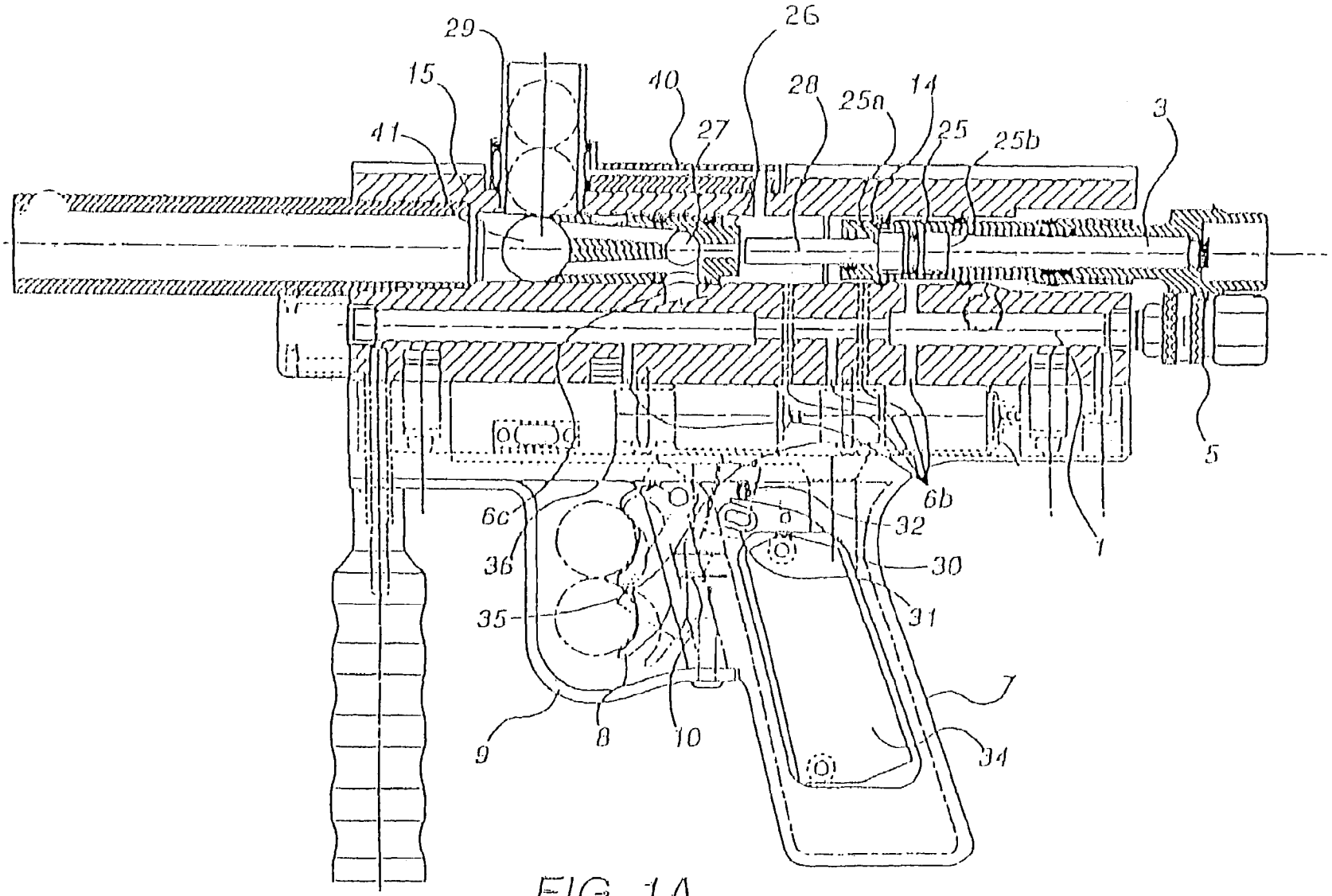
Figure 2:
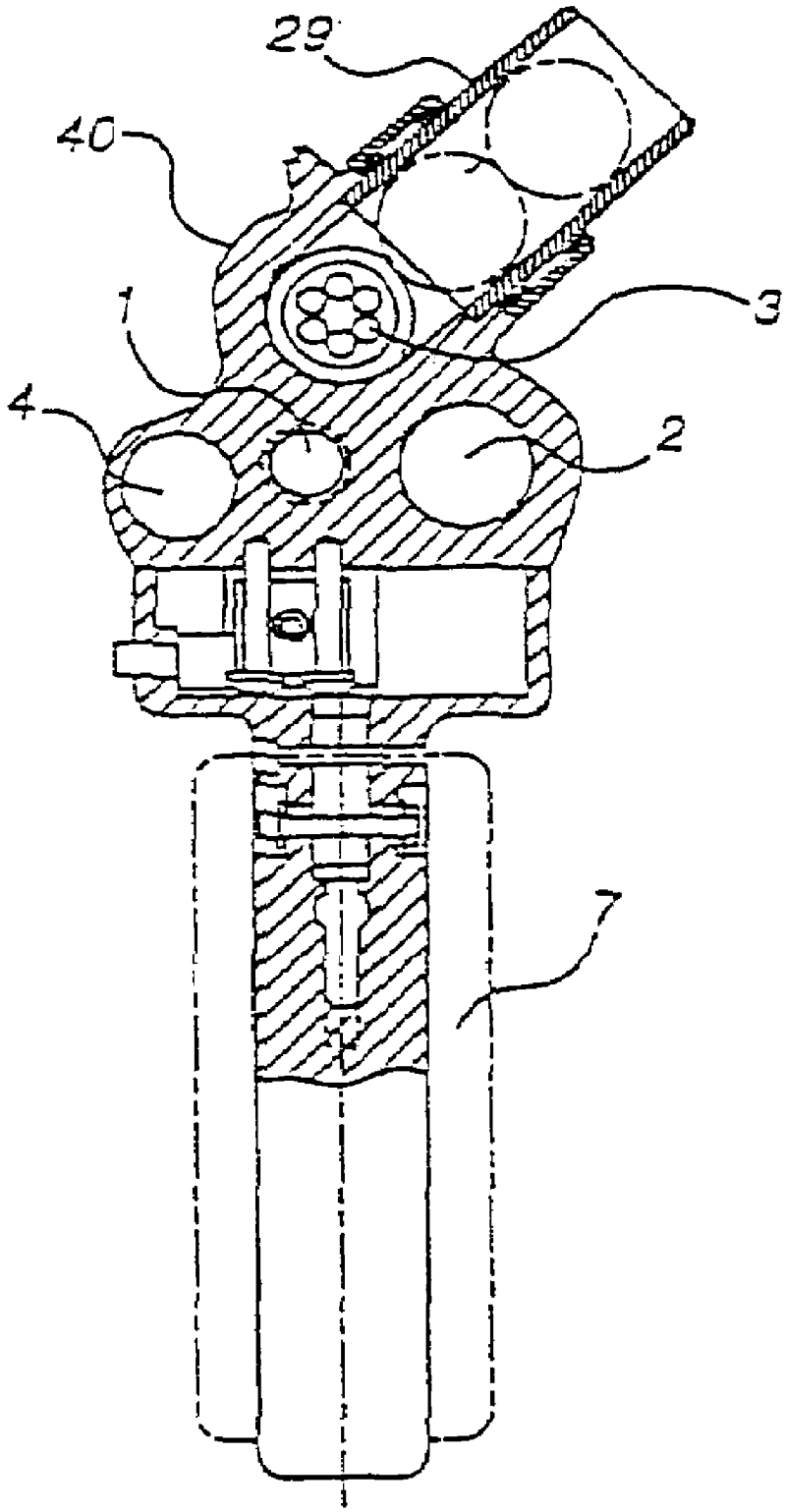
Figure 3:
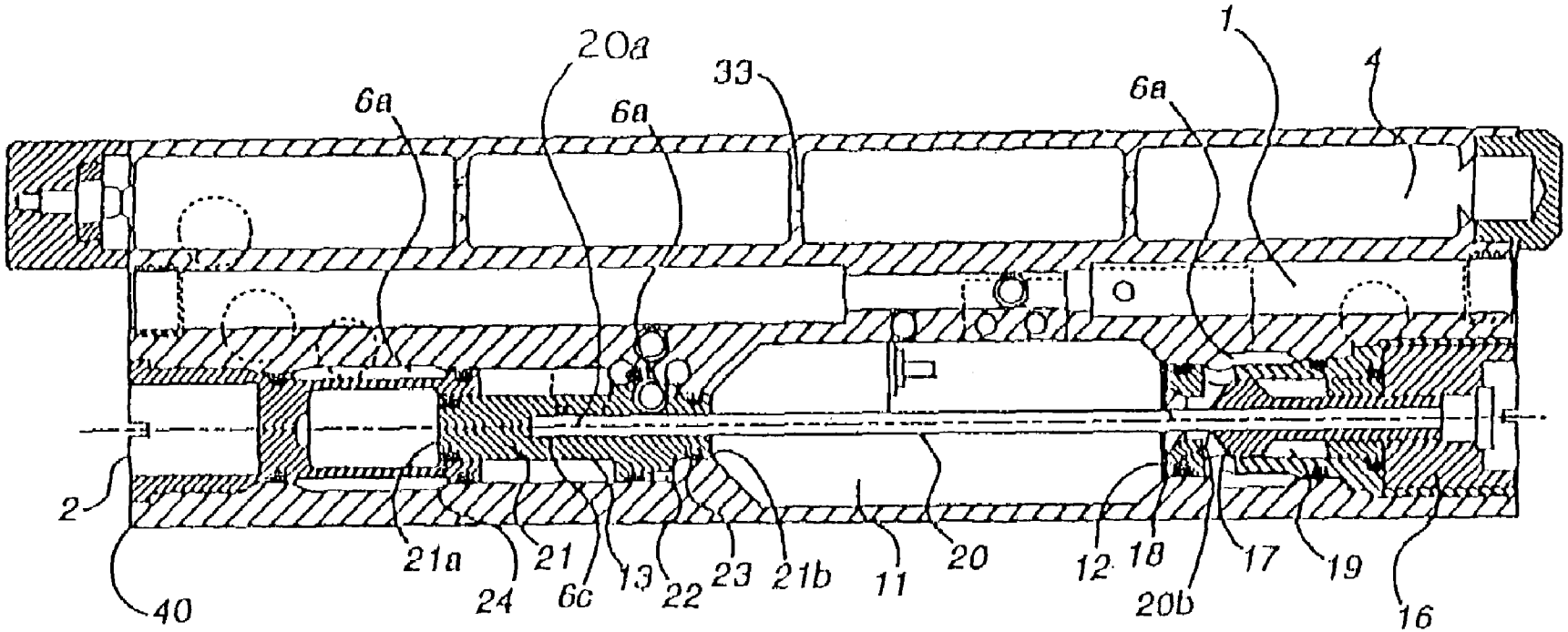

FIG. (3) is a top view of the body of the pneumatically operated projectile launching device.

DETAILED DESCRIPTION OF THE PREFERRED EMBODIMENT

The pneumatically operated projectile launching device is preferably comprised of three principal elements: a body which houses and interconnects all of the pneumatic components and also houses the electrical power source; a grip mounted to the body which includes a trigger and an electrical switch that activates the launching sequence; and an electrical control unit housed within both the body and the grip which directs flow between the pneumatic components to load, cock and fire the gun.

As shown in FIG. (2), the body preferably has three cylindrical pneumatic bores with axes that are preferably parallel to the longitudinal axis of the gun body 40. The gun body 40 can be made of materials suitable in the art for withstanding the force of the launching sequence such as metal or plastic. The first bore 1 contains compressed gas and is preferably sealed by a removable fitting 5 which is removed to inject the gas. The first bore 1 is preferably in communication with the second bore 2 and the third bore 3 through a series of ported passageways 6*a* and 6*b*, respectively, bored through the interior of the gun body 40.

As shown in FIG. (3), the second bore 2 houses the compressed gas storage chamber 11, the compressed gas filling mechanism 12 and the compressed gas releasing mechanism 13. The third bore 3 is also preferably in communication with both the first bore 1 and the second bore 2 through a series of ported passageways 6*b* and 6*c*, respectively, bored through the interior of the gun body 40. As shown in FIG. (1), the third bore 3 houses the projectile loading mechanism 14 and the projectile launching mechanism 15.

As shown in FIG. (3), the compressed gas storage chamber 11 is bordered by the interior walls of the second bore 2 and by the compressed gas filling mechanism 12 on one end and by the Compressed gas releasing mechanism 13 on the end opposite the compressed gas filling mechanism 12. The compressed gas storage chamber 11 is filled with compressed gas from the first bore 1 by means of the interconnections 6*a* between the first bore 1 and the second bore 2 when the compressed gas filling mechanism 12 is actuated. The compressed gas storage chamber 11 releases stored gas to the projectile launching mechanism 15 by means of the interconnections 6*c* between the second bore 2 and the third bore 3 when the compressed gas releasing mechanism 13 is actuated.

As shown in FIG. (3), the compressed gas filling mechanism 12 preferably consists of a valve 16 with a metallic or plastic conically or spherically shaped plug 17 which is normally shut against a metallic, plastic, or rubber conically or concavely shaped seat 18 by the loading of a spring 19 when the compressed gas filling mechanism 12 is not in its actuated position. The plug 17 is attached to a second end 20*b* of a metallic or plastic rod-shaped mechanical linkage 20 which opens the valve 16 by compressing the spring 19 when the compressed gas filling mechanism 12 is in its actuated position to create a flow path for compressed gas from the first bore 1 to the compressed gas storage chamber 11.

As shown in FIG. (3), the mechanical linkage 20 passes through the compressed gas storage chamber 11 and has a first end 20*a* which is attached to the compressed gas releasing (or firing) mechanism 13. The compressed gas releasing mechanism 13 preferably consists of a metallic or plastic cylindrical piston 21 which slides along the longitudinal axis of the second bore 2 in a space adjacent to the compressed gas storage chamber 11. A second end 21*b* of the piston 21 is adjacent to the compressed gas storage chamber 11 and is connected to the first end 20*a* of the mechanical linkage 20. The second end of the piston 21*b* has a flexible O-ring seal 23 made of rubber or other suitable synthetic sealing materials such as polyurethane that prevents gas leakage out of the compressed gas storage chamber 11 and operates as a firing valve. Compressed gas from the first bore 1 is applied to the second end of the piston 21*b* to actuate the compressed gas releasing mechanism 13 by unseating the O-ring 23 sealing the compressed gas storage chamber 11 to allow stored gas to be released from the compressed gas storage chamber 11 through the firing valve into the projectile launching mechanism 15 by means of the interconnections 6*c* between the second bore 2 and the third bore 3. The piston 21 contains a notched area 22 adjacent to the O-ring 23 that provides a surface for applying compressed gas pressure from the first bore 1 to unseat the O-ring 23 and actuate the compressed gas releasing mechanism 13.

The piston 21 has a first end 21*a* opposite the compressed gas storage chamber 11 which is subjected to pneumatic pressure to actuate the compressed gas filling mechanism 12 by transmitting through the mechanical linkage 20 a compression force on the spring 19 that opens the valve 16. The opening in the valve 16 is formed when the plug 17 is separated from the seat 18 to create a flow path for compressed gas from the first bore 1 to the compressed gas storage chamber 11 by means of the interconnections 6*a* between the first bore 1 and the second bore 2. Compressed gas from the first bore 1 is applied to the first end of the piston 2*da* to open the valve 15 and actuate the compressed gas filling mechanism 12. The first end of the piston 21*a* also contains a flexible O-ring seal 24 which prevents 20 actuating pressure leakage into the compressed gas storage chamber 11 when the compressed gas filling mechanism 12 is actuated.

As shown in FIG. (1), the third bore 3 of the gun body 40 houses the projectile loading mechanism 14 and the projectile launching mechanism 15. The projectile loading mechanism 14 preferably consists of a metallic or plastic cylindrical piston 25 which slides along the longitudinal axis of the third bore 3. The projectile launching mechanism 15 preferably consists of a metallic or plastic cylindrical bolt 26 which also slides along the longitudinal axis of the third bore 3 and which has a port 27 for receiving released gas from the compressed gas storage chamber 11 to propel a projectile 41 from the gun body 40. The bolt 26 is connected to the piston 25 by a metallic or plastic rod-shaped mechanical linkage 28, which moves the bolt 26 to receive the projectile 41 by gravity loading from the projectile feed mechanism 29 when the projectile loading mechanism 14 is actuated.

The projectile loading mechanism 14 is actuated when compressed gas from the first bore 1 is applied by means of the interconnections 6*b* between the first bore 1 and the third bore 3 to a first end 25*a* of the piston 25 which is attached to the mechanical linkage 28. This compressed gas acts against the piston 25 and the mechanical linkage 28 to drive the bolt 26 back to the cocked position which enables the loading of a projectile 41 into engagement with the bolt 26 from the projectile feed mechanism 29. The subsequent release of stored gas from the compressed gas storage chamber 11 through the bolt port 27 will drive the projectile 41 from the gun body 40. After the launching sequence has been completed compressed gas is applied from the first bore 1 to a second end 25*b* of the piston 25 opposite the mechanical linkage 25 to disable the bolt 26 from receiving a projectile 41 by driving the bolt 26 to the shut position.

The second principal element is the grip, shown in FIG. (1). The grip is mounted to the body and preferably houses three principal components, a handle 7, a trigger S and an electrical switch 30. The handle 7 can be made of any suitable material such as metal or plastic and is preferably shaped with a hand grip to allow the gun to be held in a pistol-like fashion. The metallic or plastic trigger 8 is attached to the handle 7 and preferably has a leading edge shaped to be pulled by two fingers with a cam shaped trailing edge to engage the electrical switch 30. A trigger guard 9 which prevents accidental trigger displacement is preferably attached to the trigger 8. A spring 10 preferably returns the trigger 8 to a neutral position after the electrical switch 30 has been contacted to initiate a launching sequence. The electrical switch 30 is preferably a two-pole miniature switch which contains a plunger 31 loaded by a spring 32.

As shown in FIG. (1), the third principal element is the electrical control unit which is housed within both the body and the grip. The electrical control unit preferably consists of an electrical timing circuit 34 housed in the handle 7 along with two electrically operated 3-way solenoid valves 35 and 36 housed in the gun body 40 and an electrical battery power source 33 housed in a fourth bore 4 of the gun body 40. The electrical timing circuit 34 is a network of electronic components that includes two solid state integrated circuit timers which control the launching sequence by sending energizing pulses to the solenoid valves 35 and 36 which function as electrically operated pneumatic flow distribution mechanisms. When actuated the solenoid valves 35 and 36 pass compressed gas flow from the first bore 1 and when not actuated the solenoid valves 35 and 36 operate to vent gas from the pressurized area. Upon initiation of the launching sequence the electrical timing circuit 34 energizes each solenoid valve 35 or 36 separately in a timed sequence to ensure that each solenoid valve 35 or 36 either passes or vents pressurized gas at the appropriate time within the launching sequence to propel a projectile 41 from the gun body 40.

DETAILED DESCRIPTION OF OPERATION

Before the initiation of a launching sequence the introduction of compressed gas into the first bore 1 will preferably automatically cause pneumatic pressure to be applied to the first end of piston 21*a* to cause gas flow from the first bore 1 to the compressed gas storage chamber 11 through actuation of the compressed gas filling mechanism 12 as described above. Simultaneously pneumatic pressure will preferably automatically be applied to the second end of piston 25*b* driving the bolt 26 to the shut position to disable the loading of a projectile 41. When these conditions are met the compressed gas storage chamber 11 is charged with the bolt 26 closed and the gun is ready for the initiation of a launching sequence.

A launching sequence is preferably initiated when the electrical switch 30 completes a circuit between the electrical power source 33 and the electrical timing circuit 34 as the cam shaped trailing edge of the trigger 8 contacts the plunger 31 to compress the spring 32. When contact is made the electrical power source 33 energizes the electrical timing circuit 34 which first sends an energizing pulse to actuate the first solenoid valve 35. When actuated the first solenoid valve 35 passes pressurized gas flow to the first end of piston 25*a* to actuate the projectile loading mechanism 14 by driving the bolt 26 back to the cocked position and to enable the loading of a projectile 41 into engagement with the bolt 26 from the projectile feed mechanism 29. The electrical timing circuit 34 then sends an energizing pulse to actuate the second solenoid valve 36 which then passes pressurized gas flow to the second end of piston 21*b* to actuate the compressed gas releasing mechanism 13. Simultaneously the first solenoid valve 35 returns to its non-actuated position to vent the first end of piston 25*a*. This venting in combination with the actuation of the compressed gas releasing mechanism 13 allows the stored gas released into the bolt port 27 from the compressed gas storage chamber 11 to drive the projectile 41 from the gun body 40.

After the launching sequence has been completed pneumatic pressure is again preferably automatically applied to the second end of piston 25*b* to drive the bolt 26 shut. Similarly pneumatic pressure is again preferably automatically applied to the first end of piston 21*a* to actuate the compressed gas filling mechanism 12 to re-pressurize the compressed gas storage chamber 11 as described above.

The launching sequence may then be repeated as many as nine times per second. The volume of the compressed gas storage chamber 11 and the bore interconnections 6 are preferably sized to produce projectile velocities in the 290 to 300 feet per second range at an operating gas pressure of approximately 125 pounds per square inch gauge pressure. However, the 1.5 cubic inch volume of the compressed gas storage chamber 11 and the 0.0315 square inch area of the bore interconnection orifices 6 will allow operation of the preferred embodiment at gas pressures of up to 175 pounds per square inch gauge pressure. As will be obvious to one skilled in the art, these parameters may be varied in order to allow for a differing operating gas pressure or projectile velocity.

While presently preferred embodiments have been shown and described in particularity, the invention may be otherwise embodied within the scope of the appended claims.

What is claimed is:

1. A pneumatic gun configured to use a pneumatic force to launch a projectile, comprising:

a bolt connected to a pneumatic mechanism, wherein the pneumatic mechanism comprises a pneumatic piston and cylinder assembly, and wherein the bolt is connected to the pneumatic piston through a mechanical linkage;

an electro-pneumatic flow distribution device arranged in fluid communication with a gas supply and the pneumatic mechanism to transfer compressed gas from the gas supply through the electro-pneumatic flow distribution device to the pneumatic mechanism to operate the bolt; and a compressed gas releasing mechanism configured to communicate compressed gas into the bolt during a firing operation, and wherein the bolt is configured to receive compressed gas from the compressed gas releasing mechanism into the bolt and permit it to travel through the bolt to launch a projectile during a firing operation.

2. A pneumatic gun according to claim 1, wherein the compressed gas releasing mechanism is pneumatically operated.

3. A pneumatic gun according to claim 1, wherein a rearward end of the pneumatic mechanism is arranged in fluid communication with the gas supply to close the bolt.

4. A pneumatic gun according to claim 1, wherein the electro-pneumatic flow distribution mechanism comprises a solenoid valve.

5. A pneumatic gun according to claim 4, wherein an input of the solenoid valve is connected to the gas supply and wherein an output of the solenoid valve is connected to the pneumatic mechanism.

6. A pneumatic gun according to claim 1, wherein the electro-pneumatic flow distribution device comprises a solenoid valve, and wherein a solenoid valve port is arranged in fluid communication with a forward end of the pneumatic piston to open the bolt.

7. A pneumatic gun according to claim 6, wherein the solenoid valve port is arranged in communication with the forward end of the pneumatic piston to vent compressed gas from the forward end of the pneumatic piston through the solenoid valve to permit the bolt to close.

8. A pneumatic gun configured to launch a projectile using a pneumatic force, comprising:

a bolt coupled to a pneumatic mechanism comprising a pneumatic piston and cylinder assembly, wherein said bolt is configured to receive compressed gas into the bolt and transmit the compressed gas through the bolt to launch the projectile during a firing operation; and an electro-pneumatic flow distribution device comprising a solenoid valve having a port connected in fluid communication with the pneumatic piston and cylinder assembly to supply compressed gas from the solenoid valve to the pneumatic piston to operate the bolt during each and every launching sequence.

9. A pneumatic gun according to claim 8, wherein the pneumatic piston is not integrally formed with the bolt.

10. A pneumatic gun according to claim 9, wherein the pneumatic piston is coupled to the bolt through a mechanical linkage.

11. A pneumatic gun according to claim 8, wherein compressed gas is vented from the pneumatic piston and cylinder assembly through the solenoid valve to permit the bolt to move in one direction.

12. A pneumatic gun according to claim 8, further comprising a firing valve configured to selectively release compressed gas into communication with a paintball through a port arranged in the bolt.

13. A pneumatic gun according to claim 12, wherein the bolt and the firing valve are arranged in separate longitudinal chambers of the pneumatic gun.

14. A pneumatic gun configured to launch a projectile using pneumatic force, comprising:

an electro-pneumatic flow distribution device comprising a solenoid valve having an input port and an output port, wherein the input port is connected to a compressed gas supply to receive a supply of compressed gas, wherein the output port is connected in fluid communication with a pneumatic mechanism comprising a pneumatic piston coupled to a bolt, and wherein said solenoid valve selectively transmits compressed gas through the solenoid valve to the pneumatic piston to operate the bolt during each firing cycle of the pneumatic gun; and a firing valve, wherein compressed gas is transmitted through the firing valve into the bolt and through the bolt to launch a projectile from the pneumatic gun during each and every firing cycle of the pneumatic gun.

15. A pneumatic gun according to claim 14, wherein the firing valve is pneumatically operated in response to a signal from an electronic switch.

16. A pneumatic gun according to claim 14, wherein the firing valve is coupled to a pneumatic piston and cylinder assembly.

17. A pneumatic gun according to claim 14, wherein the firing cycle of the pneumatic gun is controlled using a control circuit arranged in a grip of the pneumatic gun.

18. A pneumatic gun according to claim 17, wherein said grip further comprises a trigger-activated electronic switch.

* * * * *